US008136935B2

(12) United States Patent
Onozawa et al.

(10) Patent No.: US 8,136,935 B2
(45) Date of Patent: Mar. 20, 2012

(54) INKJET PRINTER AND INK DRYER

(75) Inventors: Yoshiki Onozawa, Tomi (JP); Ryuji Yamada, Tomi (JP)

(73) Assignee: Mimaki Engineering Co., Ltd., Nagano (JP)

( * ) Notice: Subject to any disclaimer, the term of this patent is extended or adjusted under 35 U.S.C. 154(b) by 444 days.

(21) Appl. No.: 12/486,323

(22) Filed: Jun. 17, 2009

(65) Prior Publication Data

US 2009/0322843 A1 Dec. 31, 2009

(30) Foreign Application Priority Data

Jun. 25, 2008 (JP) ..... 2008-166319

(51) Int. Cl.
*B41J 2/01* (2006.01)

(52) U.S. Cl. ..... 347/102

(58) Field of Classification Search ..... 347/102; 219/693

See application file for complete search history.

(56) References Cited

U.S. PATENT DOCUMENTS

| | | | | |
|---|---|---|---|---|
| 5,631,685 | A * | 5/1997 | Gooray et al. | 347/102 |
| 6,444,964 | B1 * | 9/2002 | Eastlund et al. | 219/695 |
| 6,508,550 | B1 * | 1/2003 | Eastlund et al. | 347/102 |
| 7,022,957 | B2 * | 4/2006 | Bakanowski et al. | 219/741 |

FOREIGN PATENT DOCUMENTS

JP 2003-022890 1/2003

* cited by examiner

*Primary Examiner* — Julian Huffman
*Assistant Examiner* — Sharon A Polk
(74) *Attorney, Agent, or Firm* — Ditthavong Mori & Steiner, P.C.

(57) ABSTRACT

An inkjet printer includes a plurality of guide walls and a plurality of choke portions. Each of the plurality of guide walls is arranged substantially in parallel with a feeding direction of a medium to provide a guide wall clearance between the plurality of guide walls. The wave guide has a first internal space connected to the guide wall clearance and an electromagnetic-wave supplier and configured to apply the electromagnetic wave to the medium which is introduced into the first internal space. Each of the plurality of choke portions includes a second internal space adjacent to each guide wall and an opening from the second internal space to the guide wall clearance. The second internal space is connected to the first internal space via the guide wall clearance. The second internal space has a length of λ/4 relative to wavelength λ of the electromagnetic wave in the feeding direction.

8 Claims, 15 Drawing Sheets

INKJET PRINTER AND INK DRYER

CROSS-REFERENCE TO RELATED APPLICATIONS

This application claims priority under 35 U.S.C. §119 to Japanese Patent Application No. 2008-166319, filed Jun. 25, 2008. The contents of this application are incorporated herein by reference in their entirety.

BACKGROUND OF THE INVENTION

1. Field of the Invention

The present invention relates to an inkjet printer and an ink dryer for the inkjet printer.

2. Discussion of the Background

In an inkjet printer, printing is conducted by ejecting dye-type ink such as acid dye, reactive dye, and substantive dye or pigment-type ink containing organic solvent such as solvent ink, onto a surface or both front and back surfaces of a sheet-like medium (recording medium) made of paper, silk, cotton, vinyl chloride, or the like. Especially in the industrial field, in such an inkjet printer, it is important to effectively dry a medium after deposition of ink onto the medium in order to quickly and easily conduct shipment and delivery after printing.

For example, JP-A-2003-22890 discloses a drying apparatus for drying ink on a medium. The drying apparatus includes a wave guide having a slot, which is configured to allow the medium to move through the slot, and an electromagnetic energy source, which is adapted to establish an electric field within the wave guide such that an angle formed between a direction of the electric field and a longitudinal axis of fibers of the medium becomes greater than ten degrees and less than or equal to ninety degrees. The drying apparatus disclosed in JP-A-2003-22890 has a wave guide choke attached to the slot in order to reduce disruption in wall currents caused in the wave guide due to the slot.

However, in the technology of allowing a medium to move through the wave guide and supplying electromagnetic waves into the wave guide so as to dry the medium, the electromagnetic waves inside the wave guide have a tendency to leak out of the wave guide along the front and back surfaces of the medium moving through the wave guide. Accordingly, since a shielding means is required to prevent the electromagnetic waves from leaking out of the wave guide, the technology has a problem of little practicability.

On the other hand, there is another method of using an electrothermal heater or the like for drying the medium. However, the electrothermal heater or the like has a problem of extremely large power consumption. Though a method of improving the drying speed of ink is also conceivable, the improvement in drying speed of ink nearly reaches the limit so that it is difficult to further speed up the drying of the media in inkjet printers only by improvement in drying speed of ink.

SUMMARY OF THE INVENTION

According to one aspect of the present invention, an inkjet printer includes an inkjet head, a plurality of guide walls, an electromagnetic-wave supplier, a wave guide, and a plurality of choke portions. The inkjet head is configured to eject ink onto a surface of a medium. Each of the plurality of guide walls is arranged substantially in parallel with a feeding direction of the medium to provide a guide wall clearance between the plurality of guide walls. The electromagnetic-wave supplier is configured to generate an electromagnetic wave. The wave guide has a first internal space. The first internal space is connected to the guide wall clearance and the electromagnetic-wave supplier and is configured to apply the electromagnetic wave to the medium which is introduced into the first internal space. Each of the plurality of choke portions includes a second internal space adjacent to each of the plurality of guide walls and an opening from the second internal space to the guide wall clearance. The second internal space is connected to the first internal space via the guide wall clearance. The second internal space has a length of $\lambda/4$ relative to wavelength $\lambda$ of the electromagnetic wave in the feeding direction.

According to another aspect of the present invention, an ink dryer for an inkjet printer includes a plurality of guide walls, an electromagnetic-wave supplier, a wave guide, and a plurality of choke portions. Each of the plurality of guide walls is arranged substantially in parallel with a feeding direction of a medium to provide a guide wall clearance between the plurality of guide walls. The electromagnetic-wave supplier is configured to generate an electromagnetic wave. The wave guide has a first internal space. The first internal space is connected to the guide wall clearance and the electromagnetic-wave supplier and configured to apply the electromagnetic wave to the medium which is introduced into the first internal space. Each of the plurality of choke portions includes a second internal space adjacent to each of the plurality of guide walls and an opening from the second internal space to the guide wall clearance. The second internal space is connected to the first internal space via the guide wall clearance. The second internal space has a length of $\lambda/4$ relative to wavelength $\lambda$ of the electromagnetic wave in the feeding direction.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
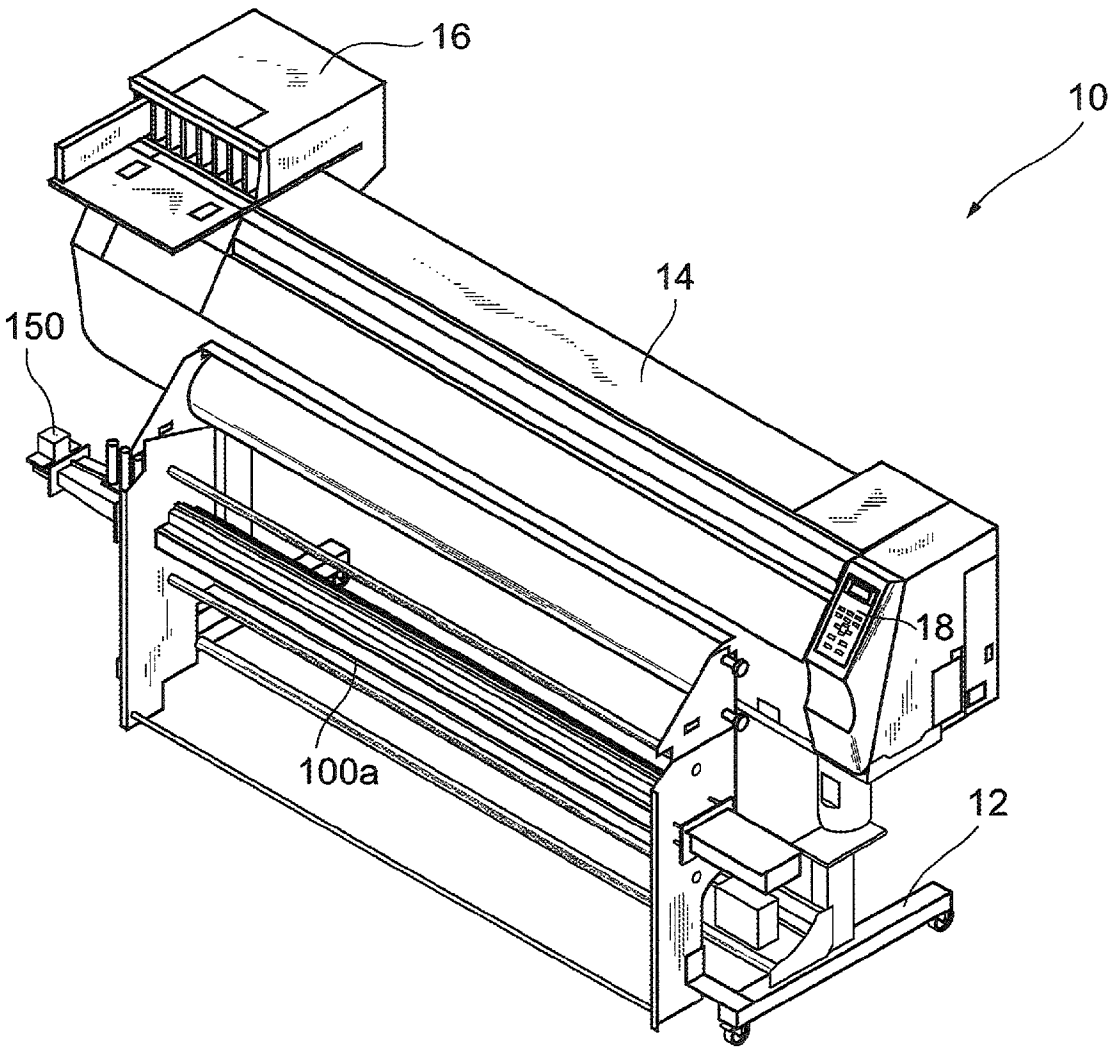
FIG. 1 is a perspective view showing an inkjet printer according to a first embodiment of the present invention.

Embodiments will now be described with reference to the accompanying drawings, wherein like reference numerals designate corresponding or identical elements throughout the various drawings.

FIG. 1 is a perspective view showing an inkjet printer according to a first embodiment of the present invention. As shown in FIG. 1, the inkjet printer 10 of this embodiment includes a printer unit 14 and a wave guide 100*a* which are mounted on a base 12. The printer unit 14 includes a toner section 16 in which inks of respective kinds to be ejected on a medium are stored and an operation section 18 by which a user conducts manipulated input. Attached to one end of the wave guide 100*a* is a magnetron 150 for supplying electromagnetic fields into the wave guide 100*a*.

Figure 2:
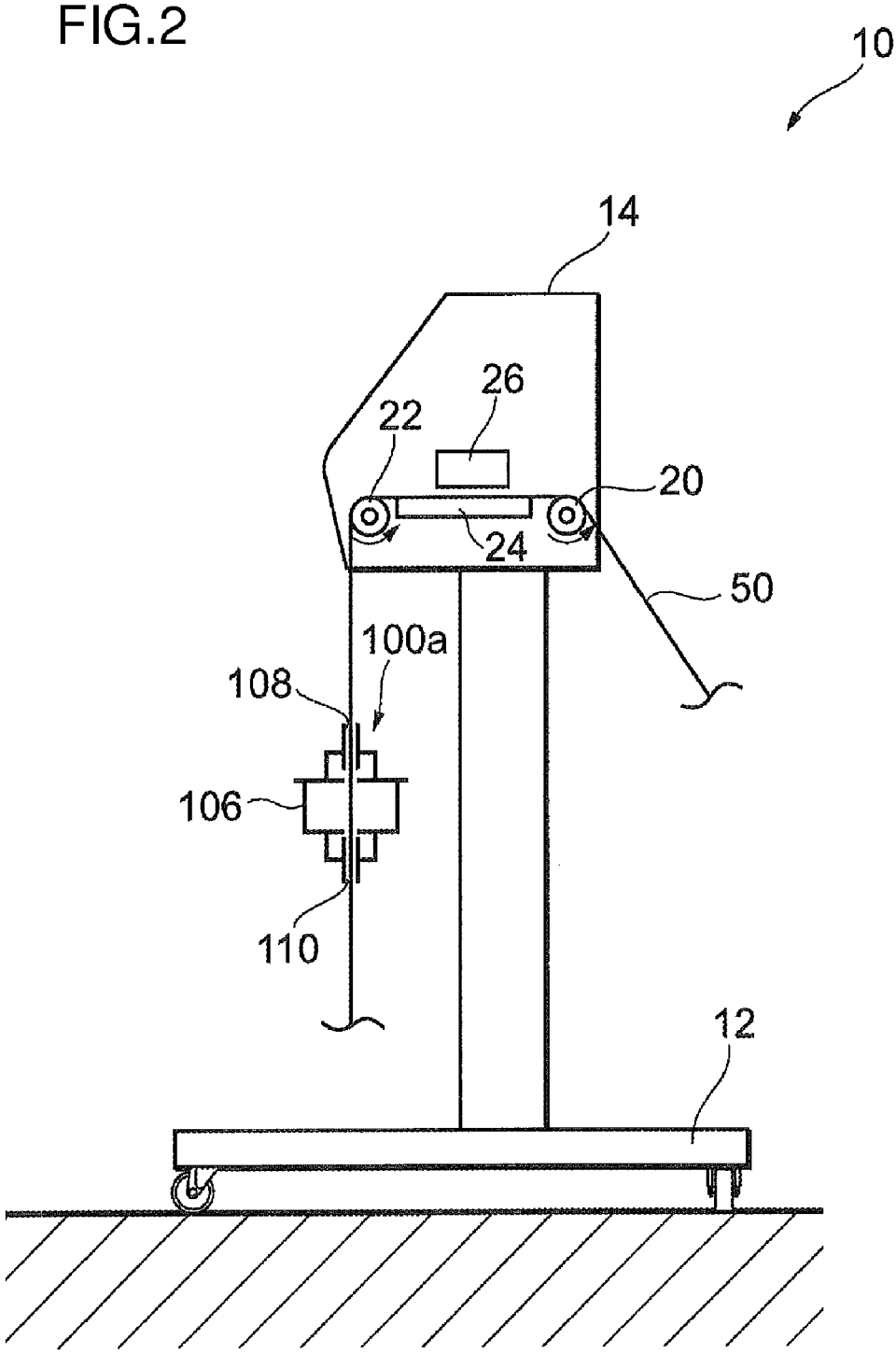
FIG. 2 is an illustration showing a state of printing and drying of a medium in the inkjet printer according to the first embodiment.

FIG. 2 is an illustration showing a state of printing and drying of a medium in the inkjet printer 10 according to the first embodiment. As shown in FIG. 2, in the inkjet printer 10 of this embodiment, a sheet-like medium 50, which is made of paper, silk, cotton, vinyl chloride or the like and is entered into the printer unit 14, is fed by rollers 20, 22. The medium 50 fed by the rollers 20, 22 is placed on a platen 24 where dye-type ink such as acid dye, reactive dye, and substantive dye or pigment-type ink containing organic solvent such as solvent ink is ejected from an inkjet head 26 onto a surface of the medium 50.

The medium 50 on which the ink was deposited is introduced into a wave guide body portion 106 through a medium introduction portion 108 of the wave guide 100*a*. Inside the wave guide body portion 106, electromagnetic waves are supplied from the magnetron 150 shown in FIG. 1. The electromagnetic waves supplied by the magnetron 150 are microwaves having a wavelength of from 100 μm to 1 m and a frequency of from 300 MHz to 3 THz, preferably, a wavelength of from 0.075 m to 0.15 m and a frequency of from 2 GHz to 4 GHz. In the wave guide body portion 106 into which electromagnetic waves are supplied, the ink deposited on the surface of the medium 50 is dried. The medium 50 entered into the wave guide body portion 106 is fed out of the wave guide body portion 106 through a medium exit portion 110.

Figure 3:
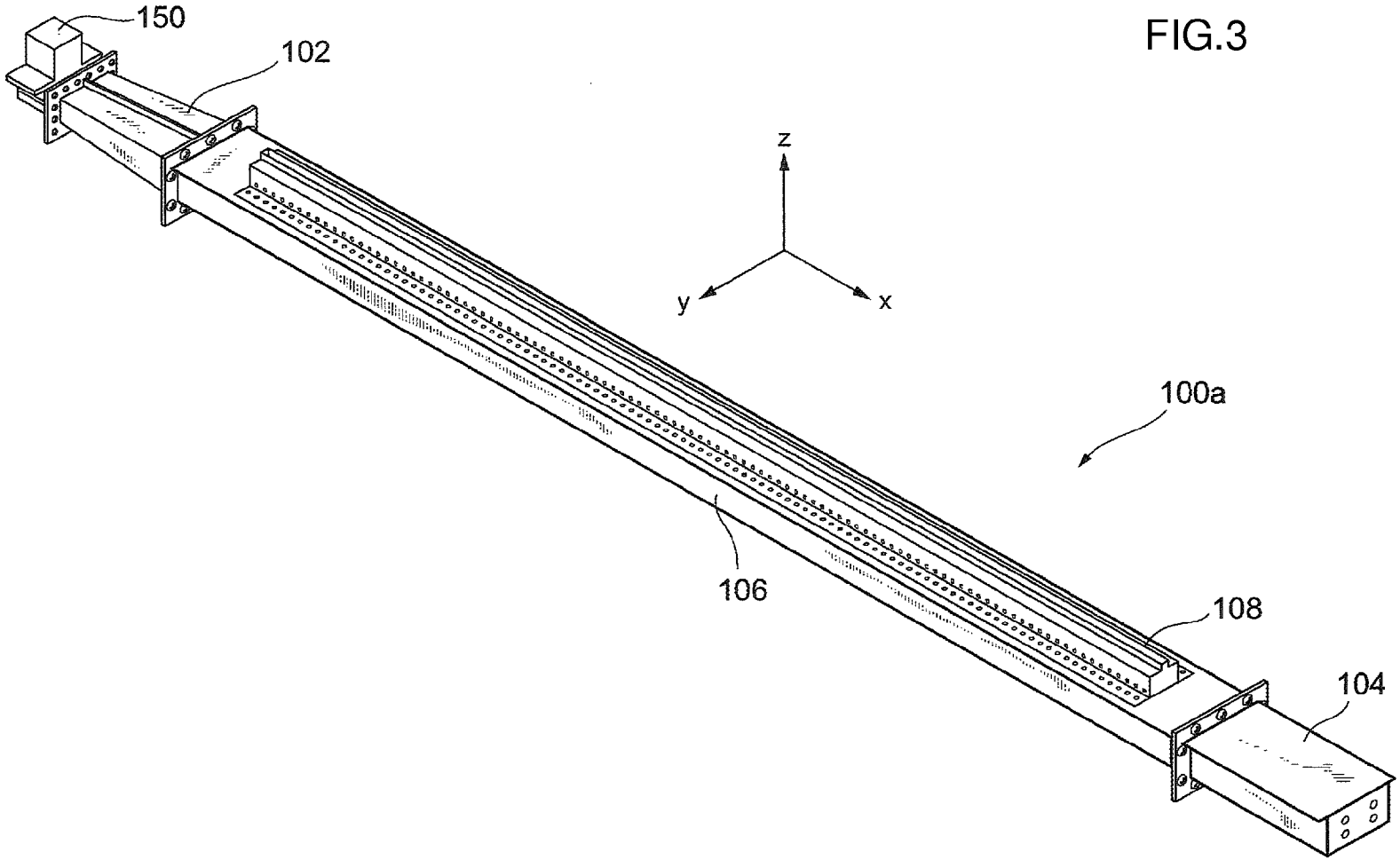
FIG. 3 is a perspective view showing a wave guide according to the first embodiment.

FIG. 3 is a perspective view showing the wave guide according to the first embodiment. As shown in FIG. 3, the wave guide 100*a* of this embodiment is a rectangular wave guide extending in a direction of illustrated X axis. The wave guide 100*a* includes an electromagnetic-wave supplying end 102, a terminal end 104, and the wave guide body portion 106. The magnetron 150 is attached to an end of the electromagnetic-wave supplying end 102. The wave guide body portion 106 is provided with the introduction portion 108 for introducing the medium 50 into the wave guide body portion 106 in a direction parallel to a plane of illustrated X-Z axes. As shown in FIG. 2, the wave guide body portion 106 is provided with the exit portion 110 for leading the medium 50 out of the wave guide body portion 106 in a direction parallel to the plane of illustrated X-Z axes. The lengths of the introduction portion 108 and exit portion 110 in the direction of illustrated X axis are determined according to the width of the medium 50 and may be, for example, in a range of from 0.2 m to 2.0 m. The terminal end 104 treats excess energy of electromagnetic waves passing through the wave guide body portion 106 from the electromagnetic-wave supplying end 102.

Figure 4:
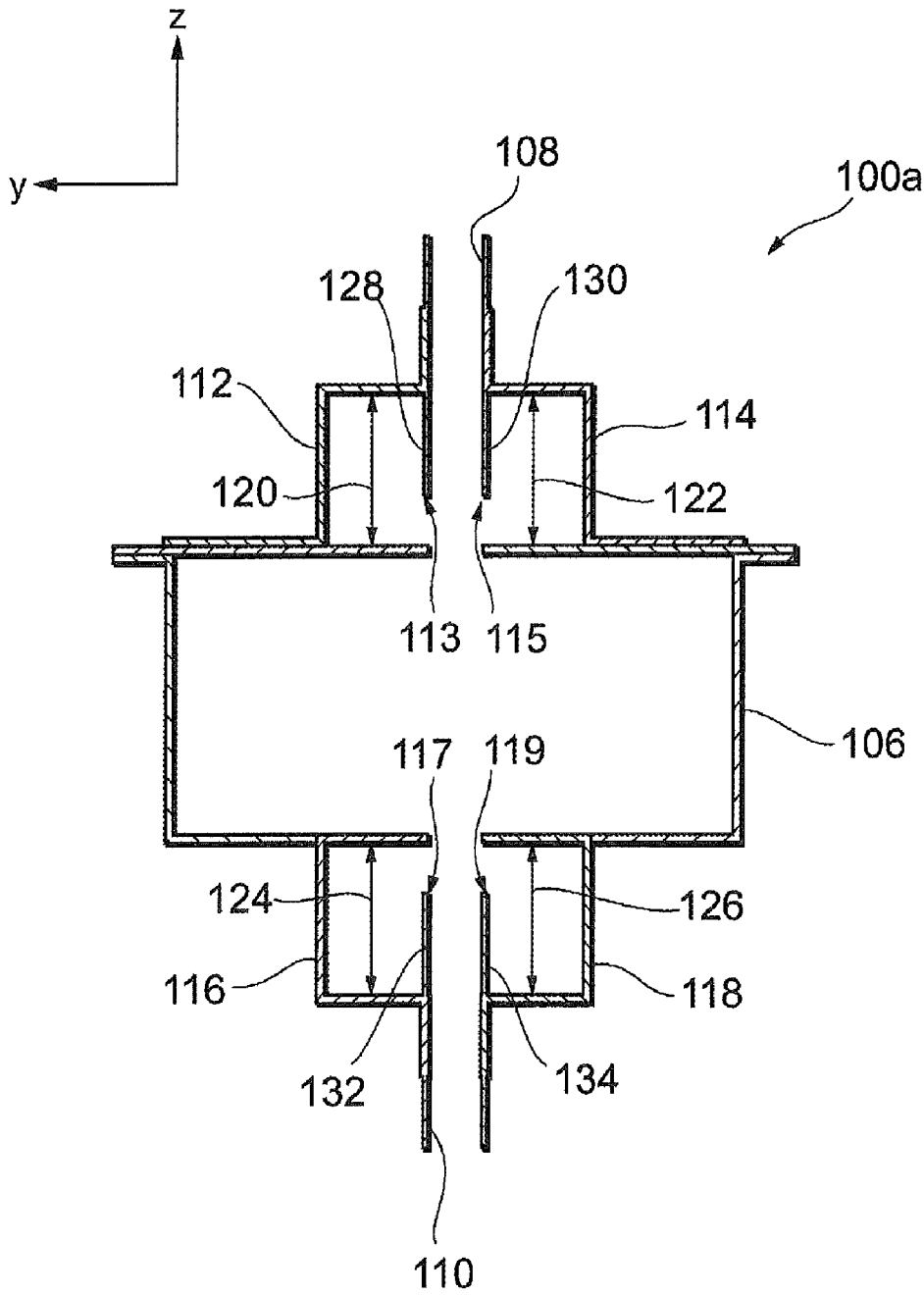
FIG. 4 is a sectional view showing the wave guide according to the first embodiment, taken along a Y-Z plane.

FIG. 4 is a sectional view of the wave guide according to the first embodiment, taken along the Y-Z plane. As shown in FIG. 4, the wave guide 100*a* of this embodiment is a rectangular wave guide having the wave guide body portion 106 of a rectangular sectional shape, in which a first internal space is provided, as seen in the section along the Y-Z plane. A pair of introduction walls 128, 130 are arranged in such a manner as to sandwich the medium 50 introduced through the introduction portion 108. The introduction walls 128, 130 extend parallel to the front and back surfaces of the medium 50 introduced. Similarly, a pair of exit walls 132, 134 are arranged in such a manner as to sandwich the medium 50 to be led-out and extend parallel to the front and back surfaces of the medium 50 led-out.

The distance (a guide wall clearance) between the introduction walls 128, 130 and the distance (another guide wall clearance) between the exit walls 132, 134 are preferably so small to prevent the electromagnetic waves from leaking out through the introduction portion 108 and the exit portion 110 and so large to prevent the medium passing through the wave guide body portion 106 from touching any of the introduction walls 128, 130 and the exit walls 132, 134, respectively. Specifically, the distance between the introduction walls 128, 130 and the distance between the exit walls 132, 134 are preferably in a range of from 0.5 mm to 0.05 m, more preferably from 0.01 m to 0.03 m, respectively.

Figure 5:
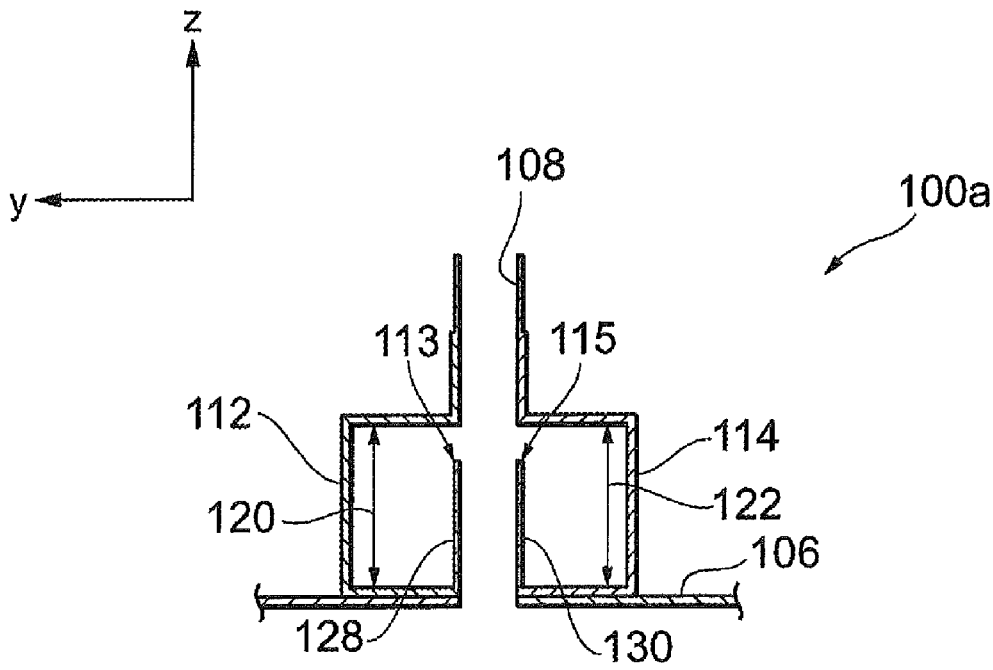
FIG. 5 is a sectional view showing an example, in which the positions of openings shown in FIG. 4 are varied, taken along the Y-Z plane.

On the outside of the introduction walls 128, 130, λ/4 choke portions 112, 114 are disposed in such a manner as to cooperate together with parts of the introduction walls 128, 130 to define quadrangular columnar inner spaces (second internal spaces), respectively. Each of the λ/4 choke portions 112, 114 has a rectangular shape as seen in the sectional view along the illustrated Y-Z plane. The λ/4 choke portions 112, 114 have openings 113, 115 communicating with the inner spaces from the introduction walls 128, 130, respectively. The openings 113, 115 are preferably formed at positions apart from the wave guide body portion 106 in the outward direction by a predetermined distance. Specifically, as shown in FIG. 4, the openings 113, 115 are preferably formed at positions closest to the inside of the wave guide body portion 106. Alternatively, as shown in FIG. 5, the openings 113, 115 are preferably formed at positions apart from the wave guide body portion 106 in the outward direction by a distance of λ/4 relative to the wavelength λ of the electromagnetic waves supplied from the magnetron 150 or at positions apart from the wave guide body portion 106 in the outward direction by a distance of λ/4×n (n is a natural number equal to or more than 1).

Similarly, on the outside of the exit walls 132, 134, λ/4 choke portions 116, 118 are disposed in such a manner as to cooperate together with parts of the exit walls 132, 134 to define quadrangular columnar inner spaces, respectively. Each of the λ/4 choke portions 116, 118 has a rectangular shape as seen in the sectional view along the illustrated Y-Z plane. The λ/4 choke portions 116, 118 have openings 117, 119 communicating with the inner spaces from the exit walls 132, 134, respectively. The openings 117, 119 are preferably formed at positions apart from the wave guide body portion 106 in the outward direction by a predetermined distance. Specifically, as shown in FIG. 4, the openings 117, 119 are preferably formed at positions closest to the inside of the wave guide body portion 106. Alternatively, the openings 117, 119 are preferably formed at positions apart from the wave guide body portion 106 in the outward direction by a distance of λ/4 relative to the wavelength λ of the electromagnetic waves supplied from the magnetron 150 or at positions apart from the wave guide body portion 106 in the outward direction by a distance of λ/4×n (n is a natural number equal to or more than 1).

Figure 6:
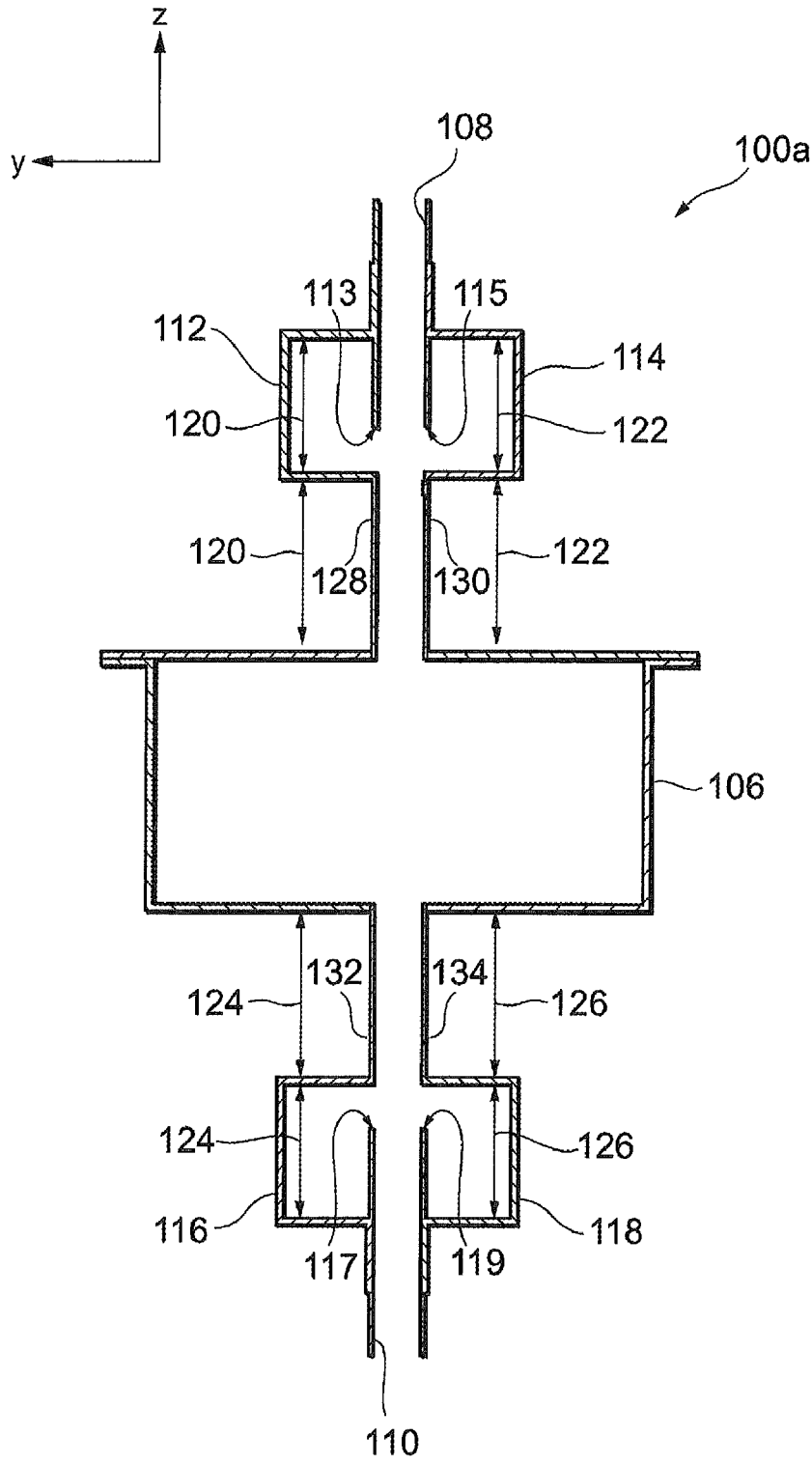
FIG. 6 is a sectional view showing an example, in which the positions of $\lambda/4$ choke portions shown in FIG. 4 are varied, taken along the Y-Z plane.

The quadrangular-columnar inner spaces having rectangular bottoms defined by λ/4 choke portions 112, 114, 116, and 118 have choke lengths 120, 122, 124, and 126, as length in a feeding direction of the medium 50 in the illustrated Z-axis direction, each of which is λ/4 relative to the wavelength λ of the electromagnetic waves supplied from the magnetron 150. The length of the openings 113, 115, 117 and 119 in the feeding direction of the medium 50 in the illustrated Z-axis direction may be ⅓ of each choke length 120, 122, 124, 126. For example, when the wavelength λ of the electromagnetic waves supplied from the magnetron 150 is 0.12 m, each of the choke lengths 120, 122, 124 and 126 may be 0.03 m which is ¼ of the wavelength λ. The length of the openings 113, 115, 117 and 119 in the feeding direction of the medium 50 in the illustrated Z-axis direction may be 0.01 m which is ⅓ of each of the choke lengths 120, 122, 124 and 126. It should be noted that, as shown in FIG. 6, the λ/4 choke portions 112, 114, 116, and 118 may be disposed at positions apart from the wave guide body portion 106 in the outward direction, for example, by distances corresponding to the choke lengths 120, 122, 124, 126.

Figure 7:
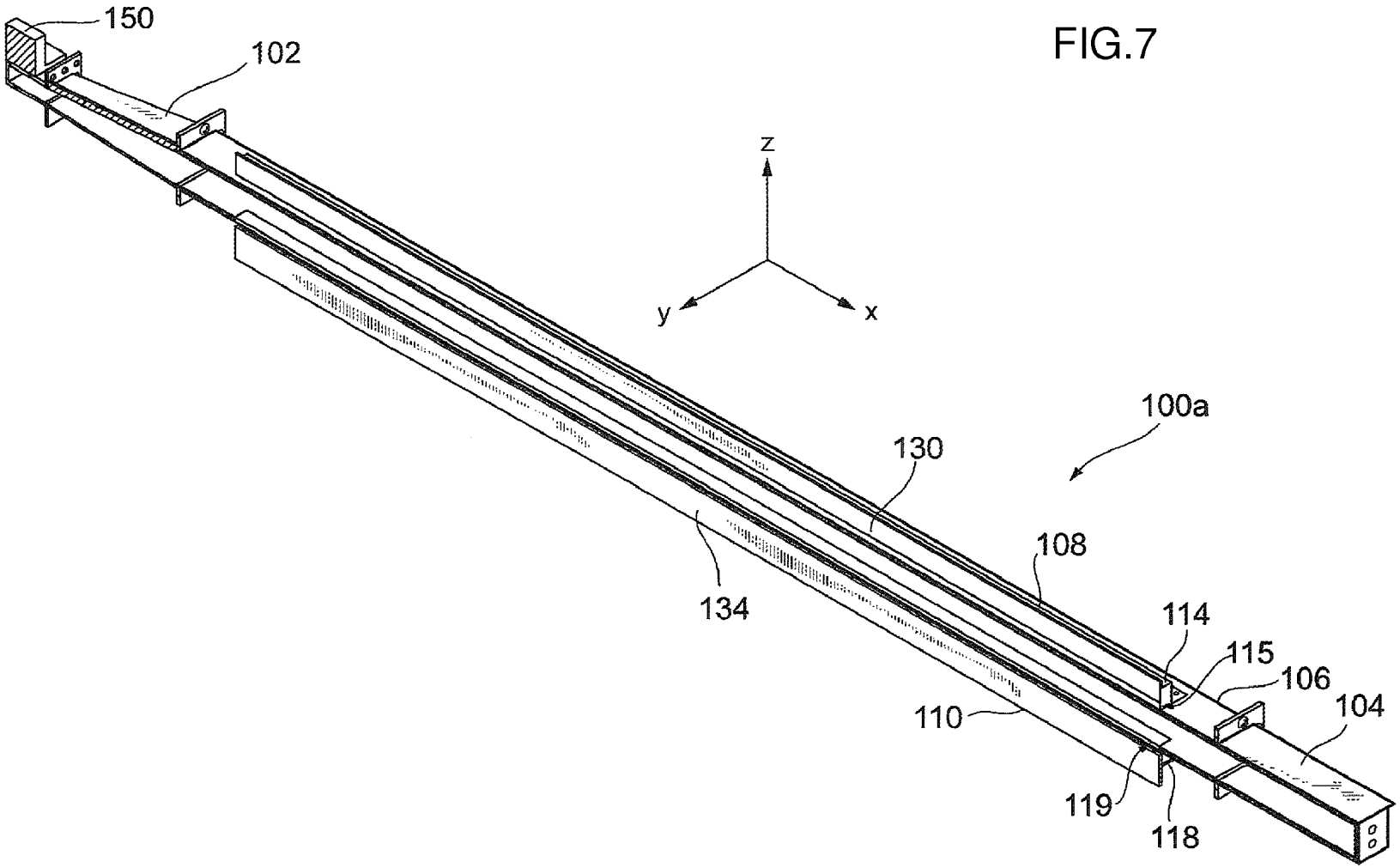
FIG. 7 is a perspective sectional view of the wave guide according to the first embodiment, taken along a X-Y plane.
Figure 8:
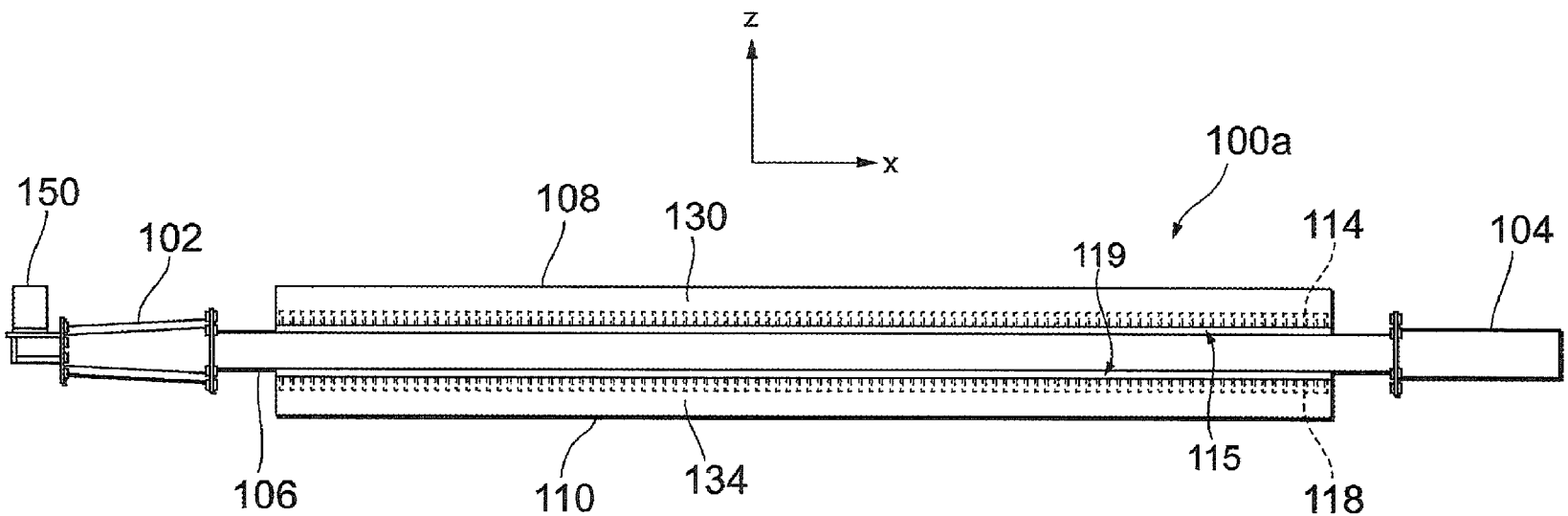
FIG. 8 is a sectional view of the wave guide according to the first embodiment, taken along the X-Z plane.
Figure 9:
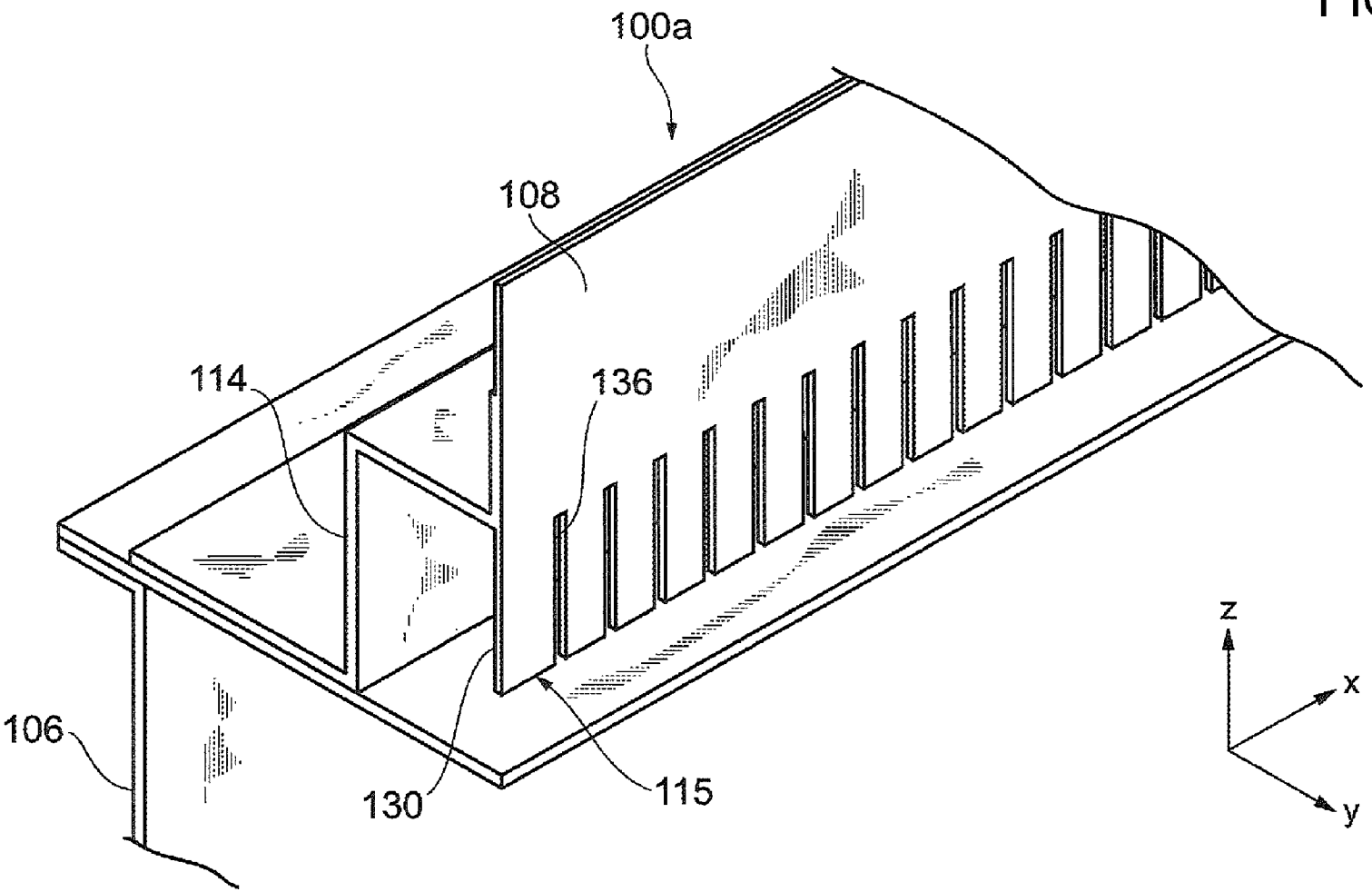
FIG. 9 is a perspective sectional view of a portion about slits of the wave guide according to the first embodiment, taken along the X-Z plane.
Figure 10:
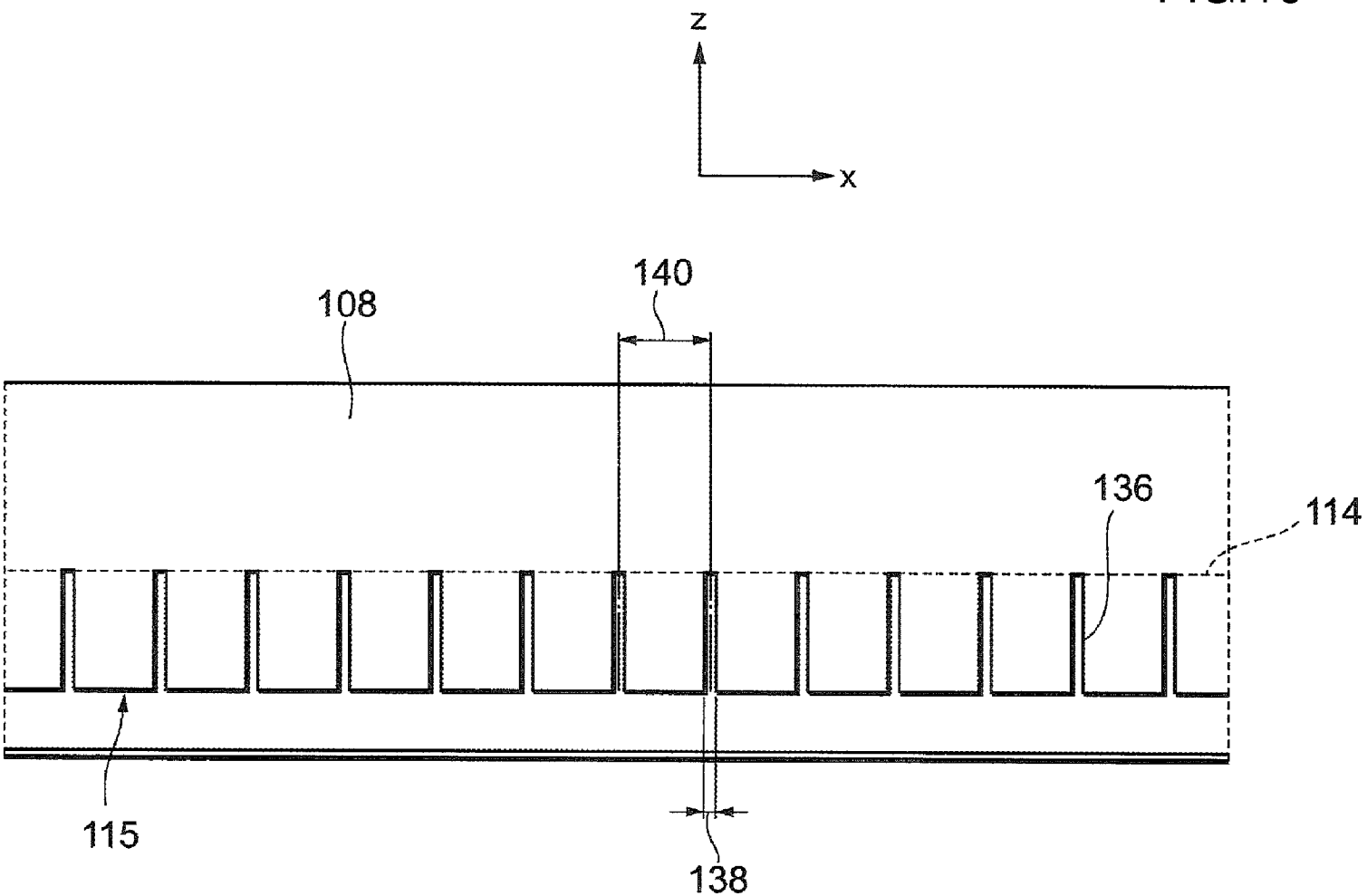
FIG. 10 is a sectional view of the portion about the slits of the wave guide according to the first embodiment, taken along the X-Z plane.

FIG. 7 is a perspective sectional view of the wave guide according to the first embodiment, taken along the X-Y plane, FIG. 8 is a sectional view taken along the X-Z plane, FIG. 9 is a perspective sectional view of a portion about slits of the wave guide according to the first embodiment, taken along the X-Z plane, and FIG. 10 is a sectional view of the portion about the slits of the wave guide according to the first embodiment, taken along the X-Z plane. As shown in FIG. 7 and FIG. 8, the introduction wall 130, the exit wall 134, and the λ/4 choke portions 114, 118 extend parallel to the illustrated X-axis direction and the openings 115, 119 compose rectangular openings in the illustrated X-Z plane.

As shown in FIG. 8 through FIG. 10, the introduction wall 130 and the exit wall 134 have silts 136 which extend from the peripheries of the openings 115, 119 in the outward direction of the wave guide 110*a*. The plurality of slits 136 are formed at equal intervals in the introduction wall 130 and the exit wall 134. The same is exactly true for the introduction wall 128, the exit wall 132, the λ/4 choke portions 112, 116, and the openings 113, 117 which are not shown in FIG. 8 through FIG. 10.

The extending direction of each slit 136 is parallel to the feeding direction of the medium 50 in the illustrated Z-axis direction. The respective slits 136 extend from the peripheral edges of the openings 113, 115, 117 and 119 to positions within the spaces defined by the λ/4 choke portions 112, 114, 116, and 118 and most distant from the wave guide body portion 106, respectively. The respective slits 136 of the introduction walls 128, 130 are formed at locations facing each other via the medium 50 introduced. Alternatively, the respective silts 136 formed in the introduction walls 128, 130 may be formed at locations alternately arranged to the front surface and the back surface of the medium 50 in a state the medium 50 introduced is sandwiched between the introduction walls 128 and 130. The width of each slit 136 in the illustrated X-axis direction is in a range of from 1 mm to 10 mm and the interval between adjacent slits 136 in the illustrated X-axis direction is in a range of from 10 mm to 30 mm.

Figure 11:
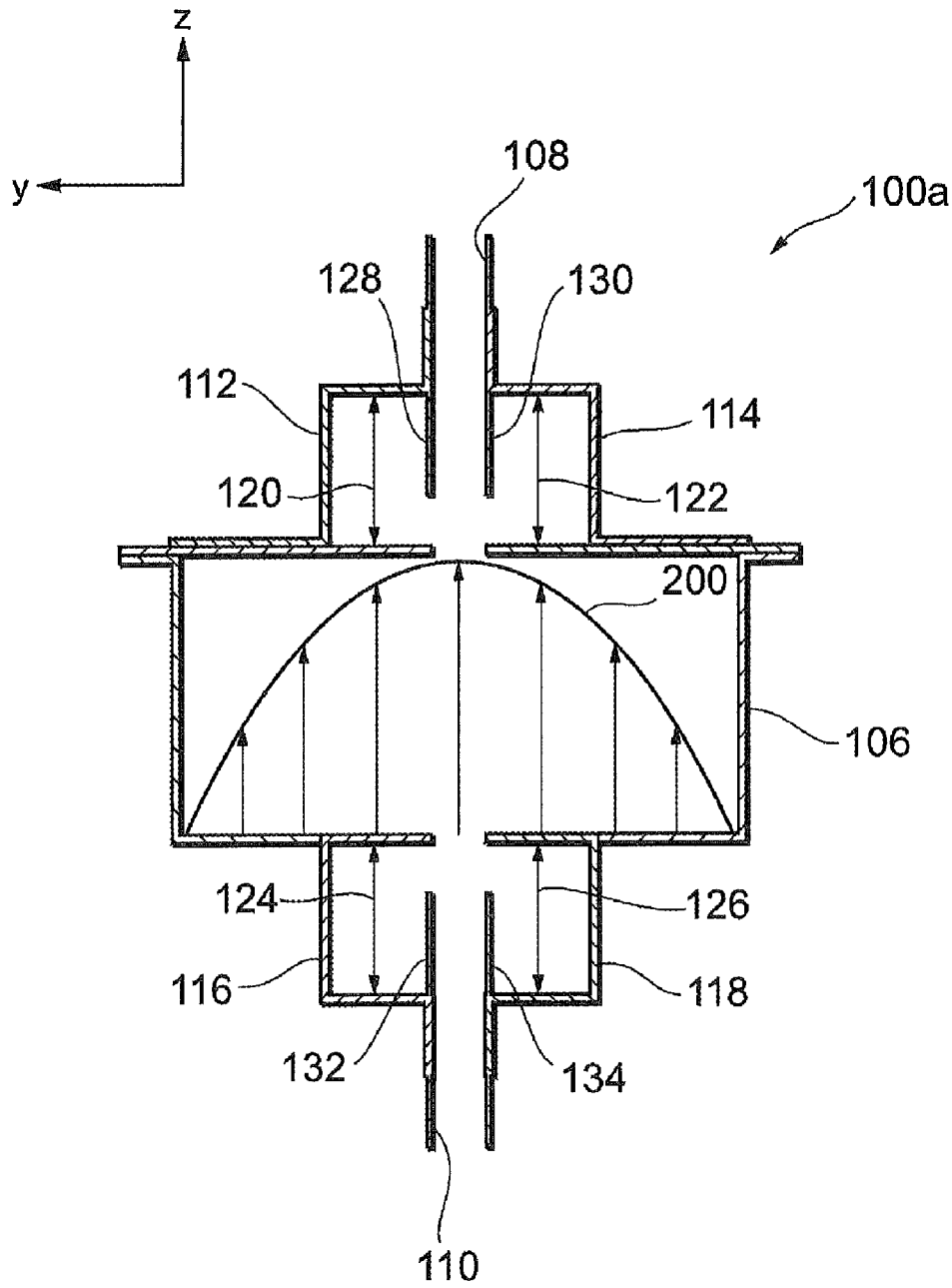
FIG. 11 is a sectional view showing an electric field in the wave guide, taken along a Y-Z plane.

Hereinafter, the operation of the inkjet printer 10 of this embodiment, especially the action of the wave guide 100*a*, will be described. In the printer unit 14, after deposition of ink onto the surface of the medium 50, the medium 50 is introduced into the wave guide 100*a*. As shown in FIG. 11, an electric field 200 in the illustrated Y-Z plane of the wave guide body portion 106 into which electromagnetic waves are supplied from the magnetron 150 is an electric field produced in the rectangular wave guide by transmission of the electromagnetic waves in $TE_{10}$ mode. Water molecules of the ink deposited on the medium 50 are vibrated with energy of the electromagnetic waves and are thereby vaporized. Therefore, the process from the printing by ejection of ink to the drying of the ink can be conducted by uninterrupted processes, thereby effectively drying the medium 50.

Figure 12:
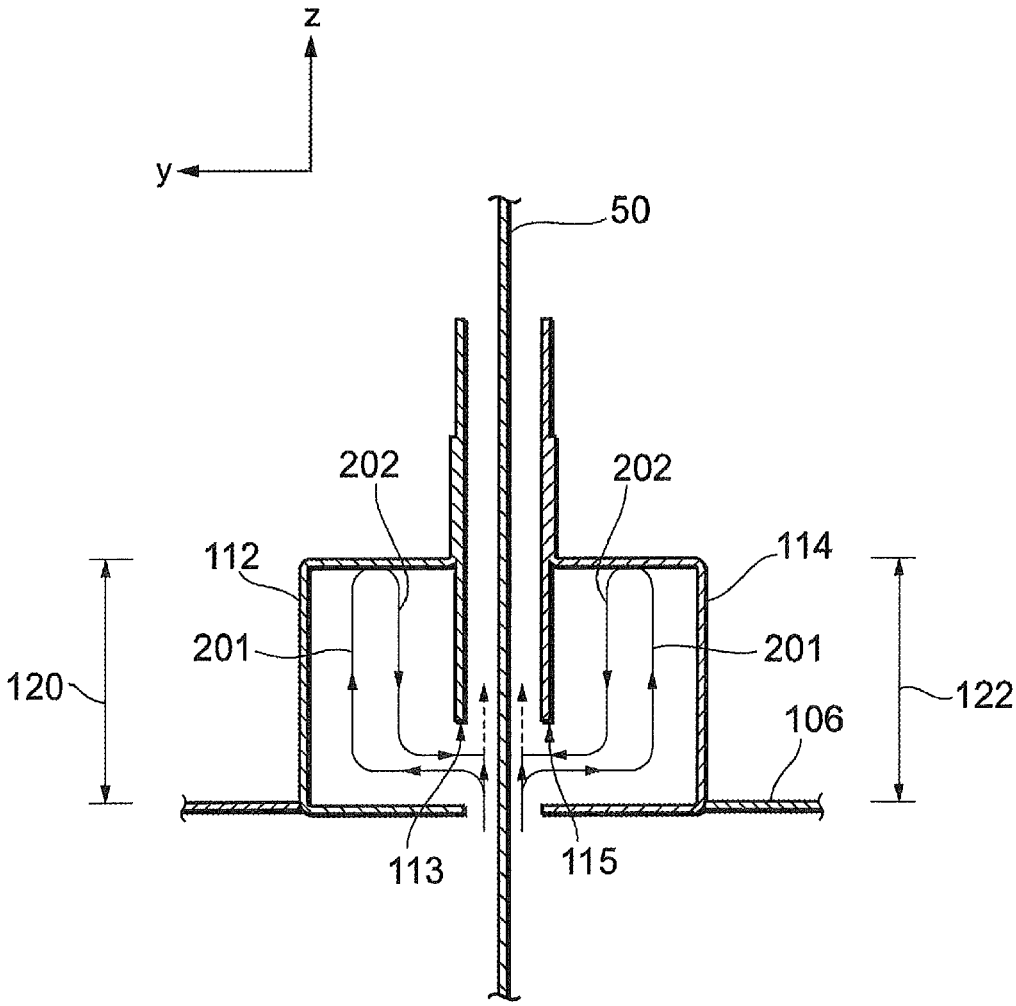
FIG. 12 is an illustration showing the movement of electromagnetic waves in the λ/4 choke portions.
Figure 13:
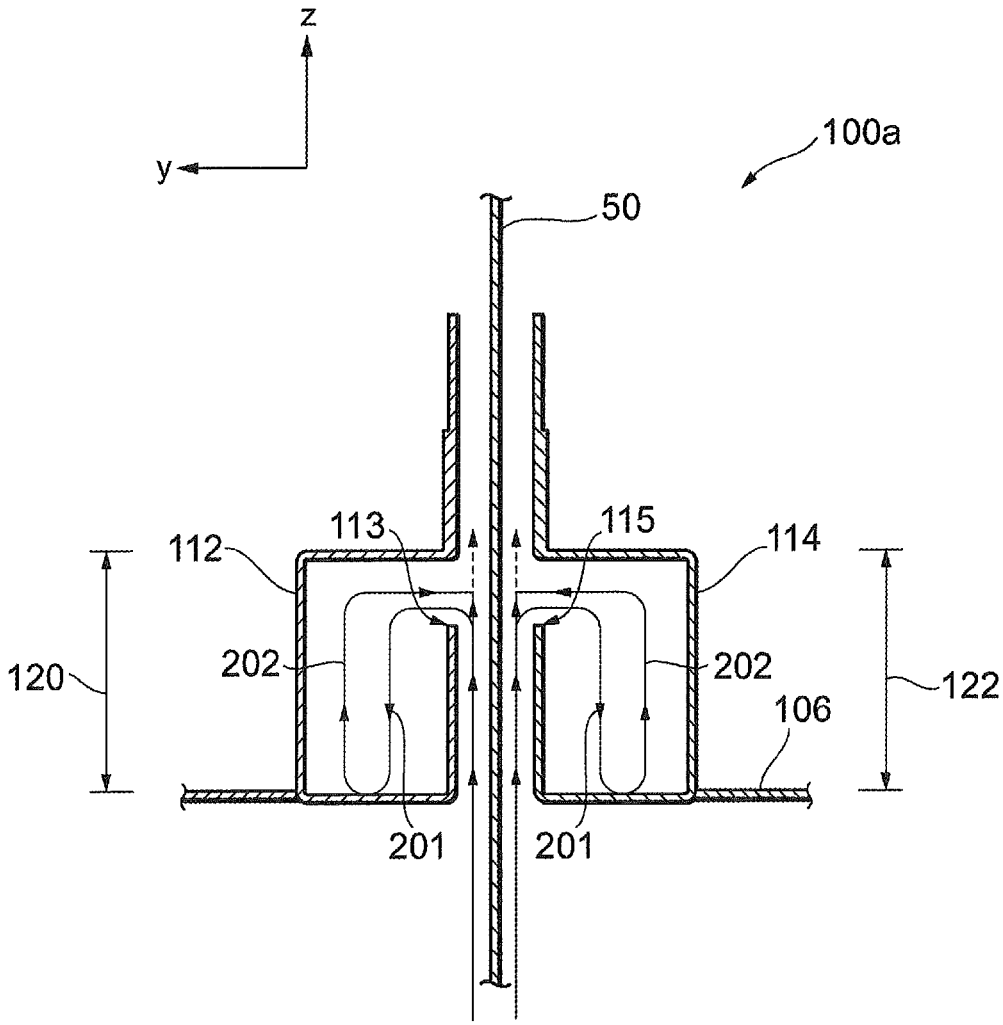
FIG. 13 is an illustration showing the movement of electromagnetic waves in the λ/4 choke portions in case shown in FIG. 5 where the positions of the openings are varied.
Figure 14:
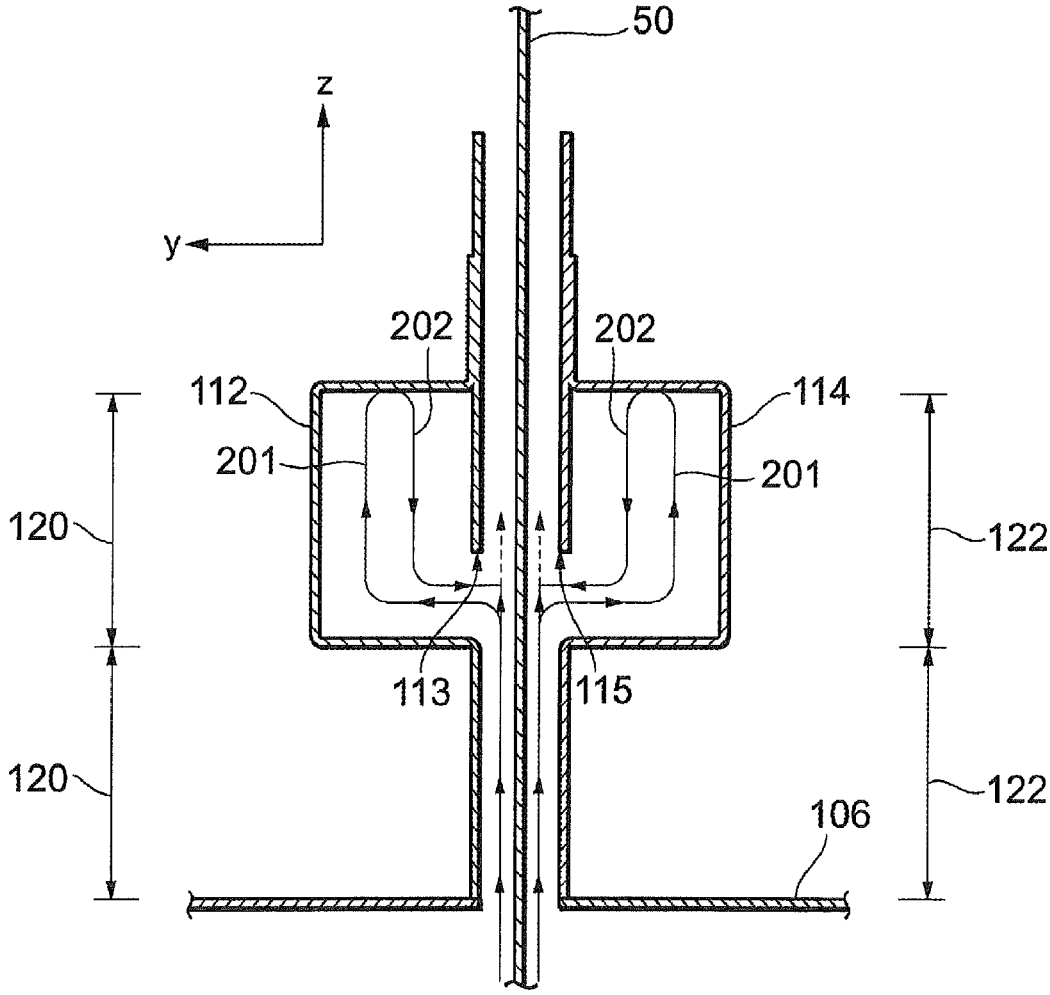
FIG. 14 is an illustration showing the movement of electromagnetic waves in the λ/4 choke portions in case shown in FIG. 6 where the positions are varied.

FIG. 12 is an illustration showing courses of the electromagnetic waves in the λ/4 choke portions. As shown in FIG. 12, the electromagnetic waves in the wave guide body portion 106 are about to leak out of the wave guide 100*a* along the sides of the medium 50. In this embodiment, incident waves 201 entered into the λ/4 choke portions 112, 114 through the openings 113, 115 are reflected at walls of the λ/4 choke portions 112, 114 after running the choke lengths 120, 122 of the λ/4 choke portions 122, 114. The reflected waves 202 are out of phase with the incident waves 201 by λ/2 so that the reflected waves 202 and the incident waves 201 attenuate each other, thereby preventing the electromagnetic waves from leaking out of the wave guide 100*a* along the sides of the medium 50. As shown in FIG. 13, the same effect is obtained also in case that the openings 113, 115 are formed at positions apart from the wave guide body portion 106 in the outward direction by a distance of λ/4. As shown in FIG. 14, the same effect is obtained also in case that the respective λ/4 choke portions 112, 114, 116, 118 are disposed at positions apart from the wave guide body portion 106 in the outward direction.

Since the slits 136 are formed in the introduction walls 128, 130 and the exit walls 132, 134 in this embodiment, it is possible to split the current flowing along the introduction walls 128, 130 and the exit walls 132, 134. Therefore, it is possible to prevent the electromagnetic waves from leaking out of the wave guide 100*a* along the introduction walls 128, 130 and the exit walls 132, 134.

Since all of the respective inner spaces of the λ/4 choke portions 112, 114, 116, 118 are located outside of the wave guide body portion 106 in this embodiment, it is possible to prevent the electromagnetic waves in the wave guide body portion 106 from being disrupted due to the choke portions 112, 114, 116, 118.

The inkjet printer 10 of this embodiment can print on a sheet-like medium 50 made of paper, silk, cotton, vinyl chloride or the like with dye-type ink such as acid dye, reactive dye, and substantive dye or pigment-type ink containing organic solvent such as solvent ink, and uninterruptedly dry the medium 50.

In case of using aqueous ink or solvent ink relative to the sheet-like medium 50 made of paper, silk, cotton, vinyl chloride or the like, acid dye or reactive dye as dye-type ink infiltrates into fibers of the medium 50 so as to spread in the fibers, thereby staining the medium 50. Therefore, the spread of the ink in the fibers of the medium 50 is promoted by electromagnetic waves supplied to the medium 50 through the wave guide 100*a* like the aforementioned embodiment, thereby improving the drying speed.

Solvent ink as pigment-type ink of an organic solvent type contains a resin therein so that the surface of the medium 50 is stained by the resin. Therefore, the drying of the moisture contained in the resin of the solvent ink is promoted by electromagnetic waves supplied to the medium 50 through the wave guide 100*a*, thereby improving the drying speed.

On the other hand, substantive dye as a dye-type ink does not infiltrate into fibers of the medium 50 and stains the medium 50 just by that the ink is deposited on the surface of the medium 50. However, even in case of the substantive dye, if a resin is contained in the ink, the drying of moisture in the resin is promoted. Accordingly, like the aforementioned embodiment, the drying speed is improved by supplying electromagnetic waves to the medium 50 through the wave guide 100*a*.

Figure 15:
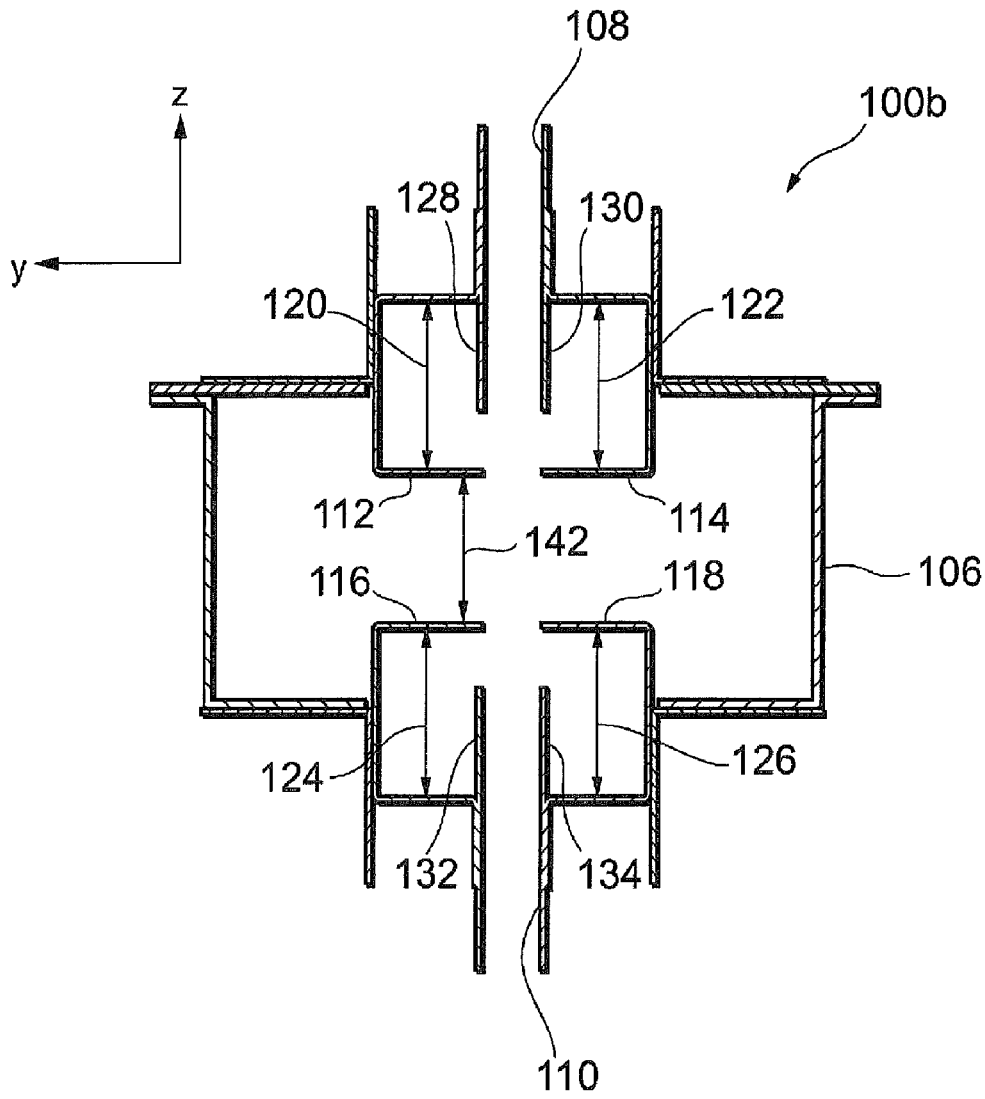
FIG. 15 is a sectional view of a wave guide according to a second embodiment of the present invention, taken along the Y-Z plane.

Hereinafter, a second embodiment of the present invention will be described. FIG. 15 is a sectional view of a wave guide 100*b* according to the second embodiment, taken along a Y-Z plane. As shown in FIG. 15, the wave guide 100*b* of this embodiment is different from that of the aforementioned first embodiment in that the respective inner spaces of the λ/4 choke portions 112, 114, 116, 118 are partly positioned inside the wave guide body portion 106. The choke distance 142 between the choke portions is set to be so large not to strike an arc within the wave guide body portion 106.

Since the respective inner spaces of the λ/4 choke portions are partly positioned inside the wave guide body portion 106 in this embodiment, the λ/4 choke portions 112, 114 of the introduction portion 108 side and the λ/4 choke portions 116. 118 of the exit portion 110 side are located close to each other so that the choke distance 142 therebetween is small, thereby increasing the strength of electric field in the wave guide body portion 106.

As described above, an exemplary embodiment of the present invention is an inkjet printer including: an ejection means for ejecting ink onto either one of front and back surfaces of a sheet-like recording medium; a wave guide which is adapted to allow the recording medium on which the ink is deposited by the ejection means to pass through the inside of the wave guide; and an electromagnetic-wave supplying means for supplying electromagnetic waves into the wave guide, wherein the wave guide has an introduction portion for introducing the recording medium into the inside of the wave guide and an exit portion for leading the recording medium out of the inside of the wave guide, wherein the introduction portion includes two introduction walls which are disposed to sandwich the recording medium introduced therebetween and are parallel to the front and back surfaces of the recording medium, respectively, and two choke portions which cooperate together with parts or all of the introduction walls, as their side surfaces, to define quadrangular columnar inner spaces, respectively and have openings communicating with the inner spaces from the introduction walls, respectively, wherein the exit portion includes two exit walls which are disposed to sandwich the recording medium to be led-out therebetween and are parallel to the front and back surfaces of the recording medium, respectively, and two choke portions which cooperate together with parts or all of the exit walls, as their side surfaces, to define quadrangular columnar inner spaces, respectively and have openings communicating with the inner spaces from the exit walls, respectively, and wherein each of the inner spaces of the choke portions has a length in a feeding direction of the recording medium which is λ/4 relative to the wavelength λ of the electromagnetic waves supplied by the electromagnetic-wave supplying means.

Since this structure includes the ejection means for ejecting ink onto the recording medium, the wave guide which is adapted to allow the recording medium on which the ink is deposited by the ejection means to pass through the inside of the wave guide; and the electromagnetic-wave supplying means for supplying electromagnetic waves into the wave guide, it is possible to effectively dry the recording medium after being printed by uninterrupted processes.

Further, the wave guide has the introduction portion for introducing the recording medium into the inside of the wave guide and an exit portion for leading the recording medium out of the inside of the wave guide. Since the introduction portion includes two introduction walls which are disposed to sandwich the recording medium introduced therebetween and are parallel to the front and back surfaces of the recording medium, respectively, and the exit portion includes two exit walls similar to the introduction walls, the recording medium on which ink is deposited by the ejection means is allowed to pass through inside the wave guide.

The introduction portion further includes two choke portions which cooperate together with parts or all of the introduction walls, as their side surfaces, to define quadrangular columnar inner spaces, respectively and have openings communicating with the inner spaces from the introduction walls, respectively, and the exit portion includes two choke portions similar to the above ones. Furthermore, each of the inner spaces of the choke portions has a length in a feeding direction of the recording medium which is λ/4 relative to the wavelength λ of the electromagnetic waves supplied by the electromagnetic-wave supplying means, the electromagnetic waves, which are about to leak out of the wave guide along the front and rear surfaces of the medium, enter through the openings. Since the reflected waves are out of phase with the incident waves by λ/2 so that an electromagnetic wave entering into the choke portion through the opening and an electromagnetic wave reflected in the choke portion are out of phase with each other by λ/2 so as to attenuate each other. Therefore, it is possible to reduce electromagnetic waves leaking out of the wave guide along the front and rear surfaces of the medium.

In this case, it is preferable that the introduction wall and the exit wall have slits which extend from the peripheries of the openings in the outward direction of the wave guide.

According to this structure, since the current flowing along the introduction walls and the exit walls can be split by the slits extending from the peripheries of the openings in the outward direction of the wave guide, it is possible to further reduce the electromagnetic waves leaking out of the wave guide along the introduction walls and the exit walls.

Further, all parts of the respective inner spaces of the choke portions may be positioned outside the wave guide.

According to this structure, since all parts of the respective inner spaces of the choke portions are positioned outside the wave guide, it is possible to prevent the electromagnetic waves in the wave guide from being disrupted due to the choke portions.

Furthermore, the respective inner spaces of the choke portions may be partly positioned inside the wave guide.

According to this structure, since the respective inner spaces of the choke portions are partly positioned inside the wave guide, the choke portion of the introduction portion and the choke portion of the exit portion are located close to each other, thereby increasing the strength of electric field in the wave guide.

An inkjet printer according to the embodiment of the present invention is capable of effectively conducting the drying of a medium with reducing the leakage of electromagnetic waves.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An inkjet printer comprising:

an inkjet head configured to eject ink onto a surface of a medium;

a plurality of guide walls each arranged substantially in parallel with a feeding direction of the medium to provide a clearance between the plurality of guide walls;

an electromagnetic-wave supplier configured to generate an electromagnetic wave;

a wave guide having a first internal space connected to the clearance and the electromagnetic-wave supplier and configured to apply the electromagnetic wave to the medium which is introduced into the first internal space; and a plurality of choke portions each comprising a second internal space adjacent to each of the plurality of guide walls and an opening extending from the second internal space to the clearance, the second internal space being connected to the first internal space via the clearance, the second internal space having a length of $\lambda/4$ relative to wavelength $\lambda$ of the electromagnetic wave in the feeding direction, wherein said plurality of guide walls have slits which extend along the feeding direction from a periphery of each opening of the plurality of choke portions.

2. The inkjet printer as claimed in claim 1, wherein the second internal space is positioned apart from said wave guide in the feeding direction.

3. The inkjet printer as claimed in claim 1, wherein at least one portion of said second internal space is positioned inside said wave guide in the feeding direction.

4. The inkjet printer as claimed in claim 1, wherein the second internal space is positioned apart from said wave guide in the feeding direction.

5. The inkjet printer as claimed in claim 1, wherein at least one portion of said second internal space is positioned inside said wave guide in the feeding direction.

6. The inkjet printer as claimed in claim 1, wherein the second internal space has a rectangular shape in a cross section perpendicular to a longitudinal direction of the wave guide.

7. An ink dryer for an inkjet printer, the ink dryer comprising:

a plurality of guide walls each arranged substantially in parallel with a feeding direction of a medium to provide a clearance between the plurality of guide walls;

an electromagnetic-wave supplier configured to generate an electromagnetic wave;

a wave guide having a first internal space connected to the clearance and the electromagnetic-wave supplier and configured to apply the electromagnetic wave to the medium which is introduced into the first internal space; and a plurality of choke portions each comprising a second internal space adjacent to each of the plurality of guide walls and an opening from the second internal space to the clearance, the second internal space being connected to the first internal space via the clearance, the second internal space having a length of $\lambda/4$ relative to wavelength $\lambda$ of the electromagnetic wave in the feeding direction, wherein said plurality of guide walls have slits which extend along the feeding direction from a periphery of each opening of the plurality of choke portions.

8. The ink dryer for an inkjet printer as claimed in claim 7, wherein the second internal space has a rectangular shape in a cross section perpendicular to a longitudinal direction of the wave guide.

* * * * *